US009107006B2

(12) United States Patent
Wang et al.

(10) Patent No.: US 9,107,006 B2
(45) Date of Patent: Aug. 11, 2015

(54) SCREEN SOUNDER

(71) Applicants: Hongxing Wang, Shenzhen (CN); Lihong Zhang, Shenzhen (CN)

(72) Inventors: Hongxing Wang, Shenzhen (CN); Lihong Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 14/243,100

(22) Filed: Apr. 2, 2014

(65) Prior Publication Data

US 2014/0301596 A1 Oct. 9, 2014

(30) Foreign Application Priority Data

Apr. 5, 2013 (CN) ..... 2013 2 0169051 U

(51) Int. Cl.

| | |
|---|---|
| ***H04R 25/00*** | (2006.01) |
| ***H04R 17/00*** | (2006.01) |
| ***H04R 1/02*** | (2006.01) |
| ***B06B 1/06*** | (2006.01) |

(52) U.S. Cl.

CPC ..... *H04R 17/00* (2013.01); *B06B 1/06* (2013.01); *H04R 1/028* (2013.01); *H04R 2217/01* (2013.01); *H04R 2499/11* (2013.01); *H04R 2499/15* (2013.01)

(58) Field of Classification Search

CPC ..... B06B 1/0292; G01S 1/72; H01L 41/00; H02N 2/186; H04R 1/04; H04R 1/005; H04R 1/083; H04R 1/222; H04R 1/406; H04R 11/00; H04R 15/00; H04R 17/00; H04R 17/02; H04R 17/005; H04R 19/00; H04R 19/01; H04R 19/016; H04R 19/02; H04R 19/04; H04R 21/02; H04R 21/021; H04R 2217/01; H04R 23/004; H04R 23/006; H04R 2499/11; H04R 2499/15; H04R 3/00; H04R 7/005; H04R 7/045

USPC ..... 381/111, 114, 162, 173, 178, 190, 191; 455/343.1, 343.2, 343.5, 550.1, 561, 455/571, 573, 574

See application file for complete search history.

(56) References Cited

U.S. PATENT DOCUMENTS

| | | | | |
|---|---|---|---|---|
| 8,288,923 | B2 * | 10/2012 | Vaidyanathan | 310/339 |
| 8,633,633 | B2 * | 1/2014 | Vaidyanathan | 310/339 |
| 2002/0107044 | A1 * | 8/2002 | Kuwata et al. | 455/550 |
| 2003/0016129 | A1 * | 1/2003 | Menard et al. | 340/531 |
| 2003/0099071 | A1 * | 5/2003 | Reineke et al. | 361/15 |
| 2005/0017673 | A1 * | 1/2005 | Tsukamoto et al. | 320/106 |
| 2011/0057546 | A1 * | 3/2011 | Vaidyanathan | 310/339 |
| 2011/0227543 | A1 * | 9/2011 | Ivanov | 320/163 |
| 2012/0154349 | A1 * | 6/2012 | Daniel et al. | 345/205 |
| 2012/0162939 | A1 * | 6/2012 | Idzik et al. | 361/752 |
| 2012/0244917 | A1 * | 9/2012 | Hosoi et al. | 455/575.1 |
| 2012/0244969 | A1 * | 9/2012 | Binder | 473/570 |
| 2012/0298165 | A1 * | 11/2012 | Kurihara et al. | 136/230 |

(Continued)

*Primary Examiner* — Khai N Nguyen

(74) *Attorney, Agent, or Firm* — IPro, Inc.; Na Xu

(57) ABSTRACT

A screen sounder includes a housing having a front case, a screen supported by the front case, a piezoelectric module mounted with the screen for driving the screen to generate sound or converting vibration of the screen into electric energy, an audio signal source electrically connecting to the piezoelectric module for driving the piezoelectric module to vibrate, a rechargeable module electrically connecting to the piezoelectric module for receiving the electric energy, and a switching control unit electrically connecting with the piezoelectric module for switching the electrical connections between the audio signal source, the rechargeable module and the piezoelectric module.

7 Claims, 5 Drawing Sheets

(56) References Cited

U.S. PATENT DOCUMENTS

2012/0299447 A1* 11/2012 Vaidyanathan ..... 310/339
2012/0329524 A1* 12/2012 Kent et al. ..... 455/566
2014/0210423 A1* 7/2014 Goto et al. ..... 320/139
2014/0334076 A1* 11/2014 Baldwin ..... 361/679.01

* cited by examiner

SCREEN SOUNDER

RELATED PATENT APPLICATION

This application claims the priority benefit of Chinese Patent Application Filing Serial Number CN 201320169051.8, filed on Apr. 5, 2013, the disclosure of which is herein incorporated by reference in its entirety.

FIELD OF THE INVENTION

The present disclosure generally relates to a display apparatus providing sound generation function, and more particularly to a portable electronic device including a screen for converting variations of electrical energy into corresponding variations of acoustic energy by a piezoelectric vibration module.

DESCRIPTION OF RELATED ARTS

In accordance with the development of a mobile communication technology, terminals such as cellular phones, personal digital assistances (PDAs), and navigations can serve as a unit that simply displays character information as well as a unit for providing various and complex multi-media contents such as audio, moving picture, radio internet web browser, or the like. Therefore, electronic information terminals having a limited size require a larger display screen, such that a display device using a touch screen has become prominent.

As is well known, in a portable electronic device such as a cellular phone, a game machine, or the like, a piezoelectric vibration module has been employed widely. Particularly, a piezoelectric vibration module performing the sound function has been mounted in a mobile device having a screen. A tactile feedback generation function using the sense of touch (vibration) is added to the touch screen, so that a feedback according to input operation performed in accordance with the type of information can be offered to the user through the sense of touch.

It is well known that, the piezoelectricity exists everywhere, and the pressure is also a kind of energy source. If a pressure is applied to a piezoelectric material, an electric potential difference will be generated (i.e., the piezoelectricity effect); and conversely, if a voltage is applied, a mechanical stress will be generated (i.e., the conversed piezoelectricity effect). If such energy that is ignored unconsciously can be collected and converted into electric energy for use, it will be beneficial to the society that suffers from a shortage of energy resources.

However, the more applications and the higher speed of the mobile phones necessitate consumption of more electric energy, so batteries of the mobile phones have become a bottleneck for the mobile phones, and how to prolong the service duration of the mobile phone batteries or how to recharge the batteries conveniently in real time have become a hot topic of research in the art.

Therefore, the present disclosure provides a screen sounder that converts the human beings' mechanical kinetic energy into electric energy by use of the existing piezoelectric vibrators in portable electronic device with an additional functional module to solve the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe the exemplary embodiments of the present disclosure in detail.

Figure 1:
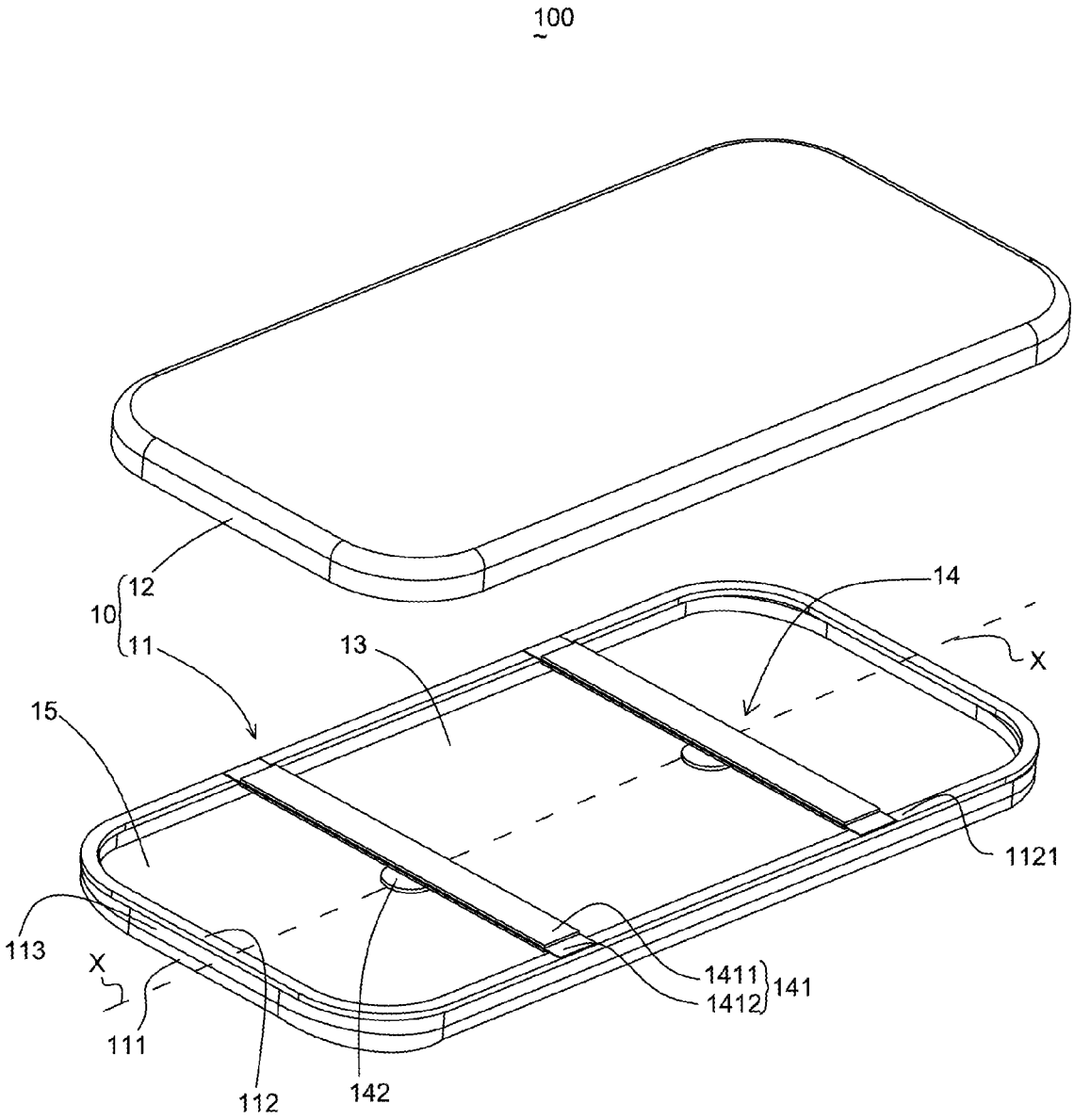
FIG. 1 is an isometric view of a screen sounder in accordance with a first exemplary embodiment of the present disclosure.
Figure 5:
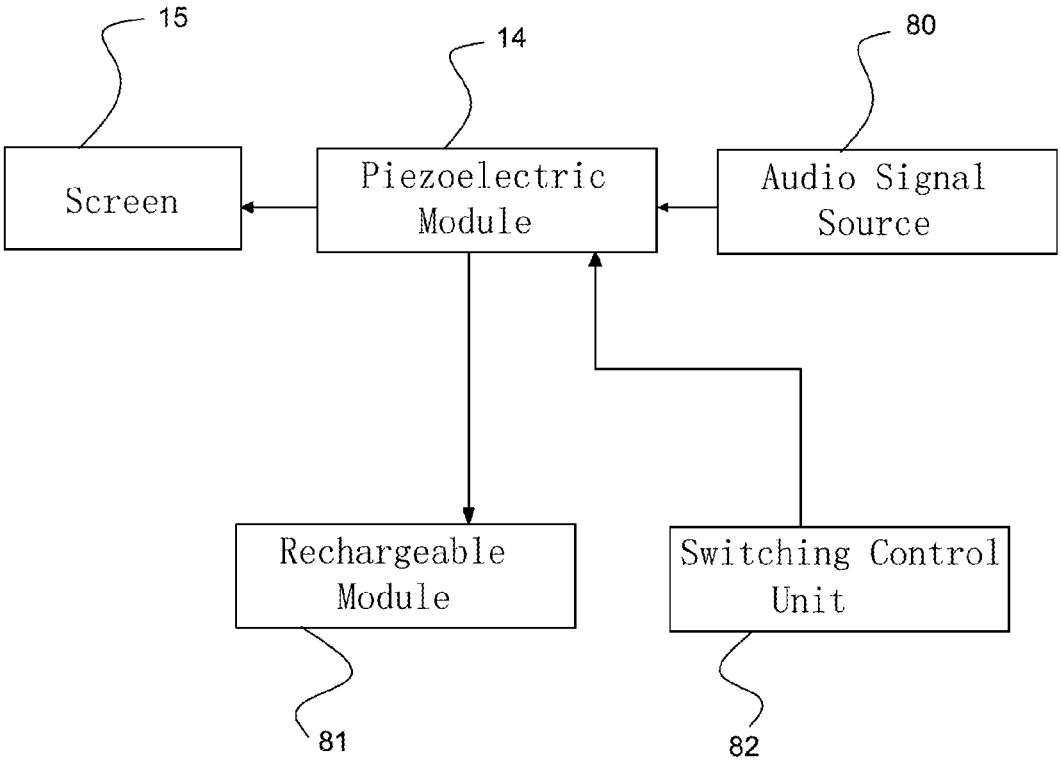
FIG. 5 is a schematic view of a configuration of a screen sounder according to an embodiment of the present disclosure.

Referring to FIGS. 1 and 5, an isometric view of a screen sounder used in a handheld device (i.e., mobile phones, PDA, panel computers or mobile powers) according to a first exemplary embodiment of the present disclosure is shown. The screen sounder 100 includes a housing 10 having a substantially rectangular shape, a screen 15 and a piezoelectric module 14 mounted with the screen 15. The housing 10 includes a front case 11 and a rear case 12 supported by the front case 11 corporately forming a receiving space 13 for accommodating the screen 15 and the piezoelectric module 14 therein. In addition, the screen sounder 100 further includes an audio signal source 80 electrically connecting to the piezoelectric module 14, a rechargeable module 81 electrically connecting to the piezoelectric module 14 and a switching control unit 82 electrically connecting with the piezoelectric module 14. Optionally, the screen 15 is not only a user interface for displaying various information to the user but also a sound generator which generates sound by vibration activated by the piezoelectric module 14.

The switching control unit 82 is configured to interrupt the electrical connection between the audio signal source 80 and the piezoelectric module 14 according to the work mode of the piezoelectric module. That is to say, when the piezoelectric module 14 receives an audio signal from the audio signal source 80, the switching control unit 82 will interrupt the electrical connection between the piezoelectric module 14 and the rechargeable module 81, then the piezoelectric module 14 drives the screen 15 to generate sound. Alternatively, the screen causes elastic deformation by an external force so as to cause the piezoelectric module to deform, thereby producing electric energy based on piezoelectricity effect. Then, the switching control unit 82 will interrupt the electrical connection between the piezoelectric module 14 and the audio signal source 80, accordingly, the electric energy is inputted into the rechargeable module 81.

In the embodiment, the front case 11 includes a ring-shaped frame 111 which has a rectangular outside forming a circular opening for supporting the screen 15, a bracket 112 supported by the frame 111. Furthermore, the front case 11 further includes an annular gasket 113 sandwiched between the frame 111 and the bracket 112 for sealing the screen sounder 100 and providing a restoring force to the screen 15.

The shape of the bracket 112 is substantially identical to the gasket 113 in the present embodiment. The bracket 112 includes a sidewall 1121 for supporting the piezoelectric module 14.

The piezoelectric module 14 with a narrow rectangular shape includes a piezoceramic plate 141 and a connecter 142 mounted on the piezoceramic layer 141 for transmitting force. One end of the connecter 142 is fixed on the piezoceramic plate 141 and the other end is fixed on the back side of the screen 15. Another word, the connecter 142 is located between the piezoceramic plate 141 and the screen 15, with two ends thereof connecting with the piezoceramic plate 141 and the screen 15, respectively. The piezoceramic plate 141 includes a substrate 1411 and a piezoelectric ceramic layer 1412 mounted on both sides of the substrate 1411. It is just like a bridge that two ends of the substrate 1411 are mounted on two sidewalls 1121 of the bracket 112. Based on Conversed Piezoelectricity Effect, the piezoceramic plate 141 drives the screen 15 to vibrate so as to generate sound in a frequency range via the connecter 142. Conversely, based on Piezoelectricity Effect, a deforming force from the screen 15 is transmitted to the piezoceramic plate 141 via the connecter 142. The deforming force is converted by the piezoelectric ceramics plate 141 into the electric energy to charge the rechargeable module 81.

In this embodiment, the screen sounder 100 includes two piezoelectric modules 14 parallel to each other which are attached to the screen 15 by two connecters 142, respectively. In another word, each piezoelectric module 14 includes at least one connecter 142. As shown in FIG. 1, two piezoelectric modules 14 are arranged parallel to each other perpendicularly to a long central axis direction X of the front case 11. Two connecters 142 are arranged in a line which is substantially parallel to the long central axis direction X of the front case 11. FIG. 1 illustrates only two piezoelectric modules 14, but, the amount of the piezoelectric modules are not limited to two, and may be adjusted according to actual requirement.

Figure 2:
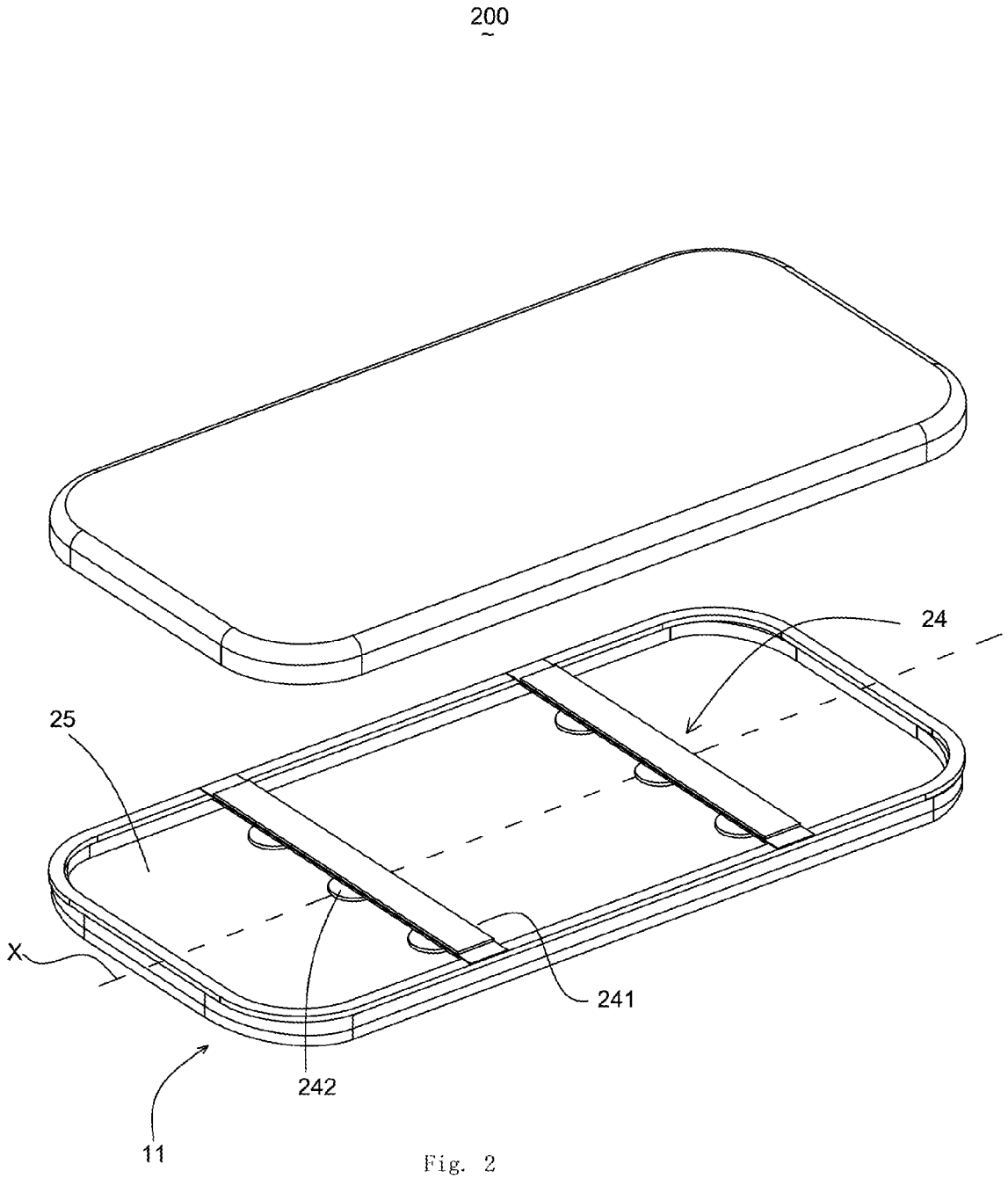
FIG. 2 is an isometric view of a screen sounder in accordance with a second exemplary embodiment of the present disclosure.

Referring to FIG. 2, which shown a second embodiment of the present disclosure, the screen sounder 200 includes two piezoelectric modules 24 having a piezoelectric ceramic plate 241 and a connecter 242. In the embodiment, each piezoelectric module has three connecters 242 which are located between a screen 25 and the piezoelectric ceramic plate 241. Three connecters are arranged in a row perpendicularly to a long central axis direction X of a front case 21. Other components shown in FIG. 2 but not mentioned have the same configurations and functions to the first embodiment. The amount of the connecter is not limited to three, and may be adjusted according to actual requirement.

Figure 3:
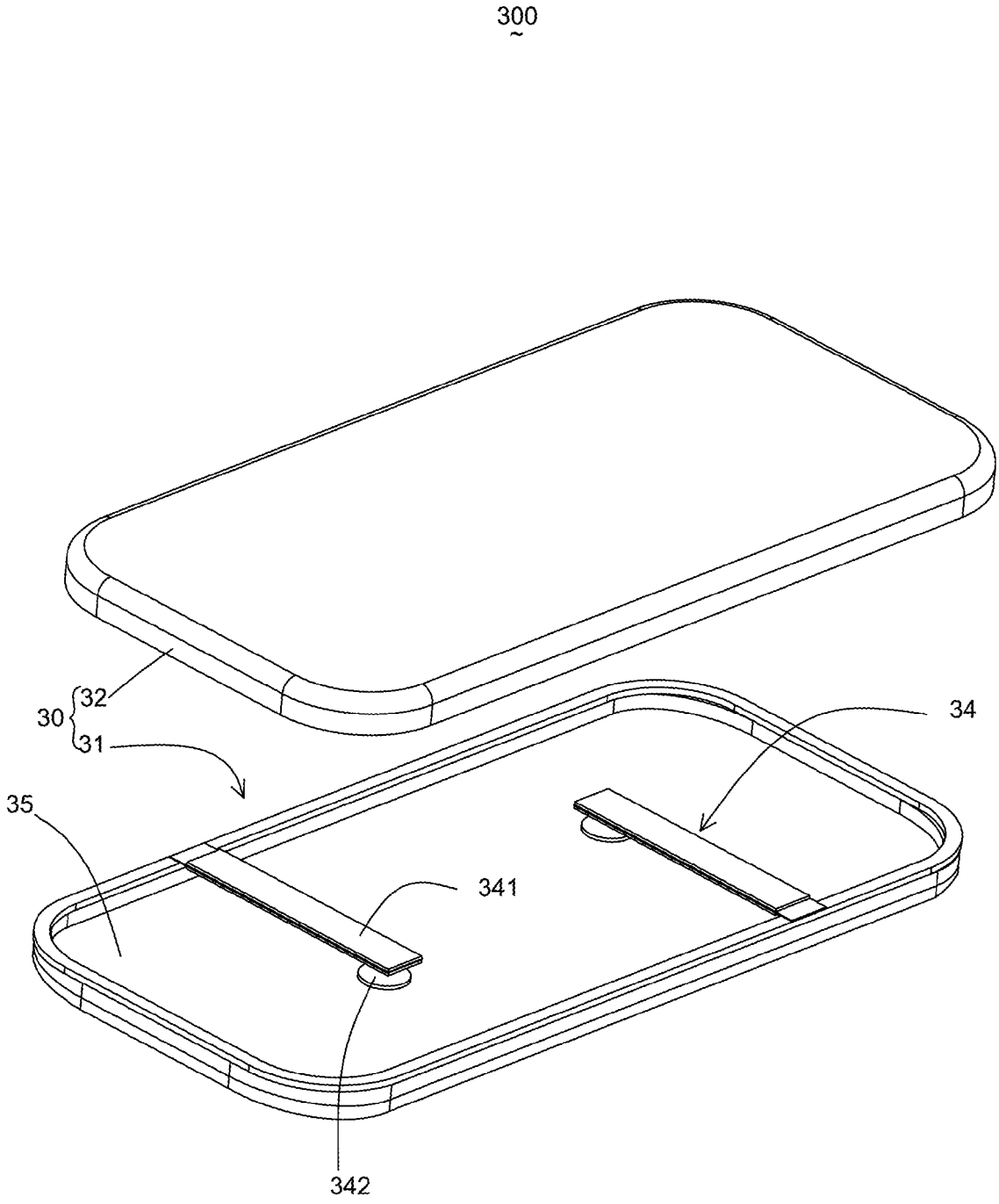
FIG. 3 is an isometric view of a screen sounder in accordance with a third exemplary embodiment of the present disclosure.

Referring to FIG. 3, which shown a third embodiment of the present disclosure, the screen sounder 200 includes a housing 30 having a front case 31 and a rear case 32, a screen 35 and two piezoelectric modules 34. Each piezoelectric module 34 includes a piezoelectric ceramic plate 341 and a connecter 342. The structure of the housing 30 and the screen 35 shown in the FIG. 3 is equal to that of the housing 10 and screen 15. Somewhat differently, the piezoelectric ceramic plate 341 has one end mounted on the front case 31, and the other end supported by the connecter 342. The connecter 342 is located on the central of the screen 35.

Figure 4:
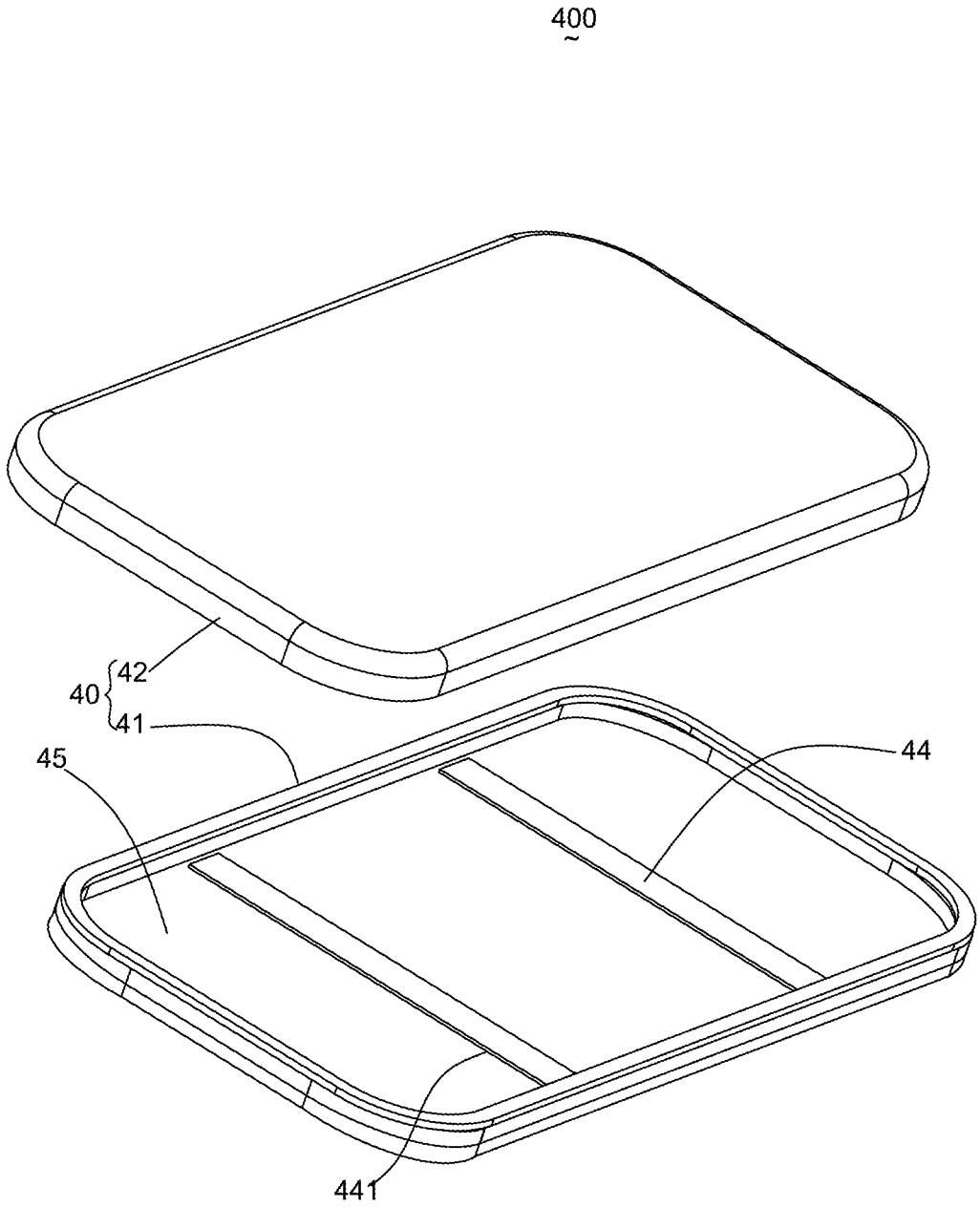
FIG. 4 is an isometric view of a screen sounder in accordance with a fourth exemplary embodiment of the present disclosure.

Referring to FIG. 4, which shows a fourth embodiment of the present disclosure, the screen sounder 400 includes a housing 40 having a front case 41 and a rear case 42, a screen 45, and a pair of piezoelectric modules 44. The piezoelectric module 44 includes a piezoelectric ceramics plate 441. What is distinguished from the other embodiments is that the piezoelectric ceramics plate 441 is directly glued to the screen 45 so as to omit a connecter. Furthermore, the piezoelectric module 44 mounted on the screen by a plate layer severing as a connecter. The shape of the plate layer is substantially identical to the piezoelectric module 44. Consequently, the screen 45 can transmit more deforming force to the piezoelectric module 44 so as to convert into more electric energy. Other components shown in FIG. 4 but not mentioned have the same configurations and functions to the first embodiment.

The present disclosure describes a handheld device using a piezoelectric module attached to the screen. In fact, the piezoelectric module may be mounted with the housing. Vibration of the handheld device is converted to electric energy by deformation of the piezoelectric module for recharging the handheld device.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A screen sounder, comprising:

a housing having a front case, a rear case supported by the front case;

a screen supported by the front case;

the front case including a frame for supporting the screen, a bracket supported by the frame and an annular gasket sandwiched between the frame and the bracket;

a piezoelectric module mounted with the screen;

an audio signal source electrically connecting to the piezoelectric module for driving the piezoelectric module to vibrate;

a rechargeable module electrically connecting to the piezoelectric module for receiving the electric energy;

a switching control unit electrically connecting with the piezoelectric module for switching the electrical connections between the audio signal source, the rechargeable module and the piezoelectric module.

2. The screen sounder as described in claim 1, wherein the piezoelectric module includes a piezoceramic plate and a connecter mounted on the piezoceramic layer, one end of the connecter fixed on the piezoceramic plate and the other end attached to the screen, the piezoceramic plate including a substrate and a piezoelectric ceramic layer mounted on a side of the substrate.

3. The screen sounder as described in claim 2, wherein two ends of the piezoelectric substrate are supported by two sidewalls of the bracket, respectively.

4. The screen sounder as described in claim 3, wherein three connecters are arranged in a row which are substantially perpendicularly to a long central axis direction of the front case.

5. The screen sounder as described in claim 2, wherein one end of the piezoelectric substrate is mounted on the bracket and the other end of the piezoelectric substrate is supported by the connecter, the connecter is located on the central of the screen.

6. The screen sounder as described in claim 2, wherein the piezoelectric ceramic plate is directly glued to the screen.

7. The screen sounder as described in claim 2, wherein a plate layer serving as a connecter sandwiched between the piezoelectric module and the screen, the shape of the plate layer is substantially identical to the piezoelectric module.

* * * * *